US009693639B2

(12) United States Patent
Corso et al.

(10) Patent No.: US 9,693,639 B2
(45) Date of Patent: Jul. 4, 2017

(54) CHILD SLEEPING AND ROCKING APPARATUSES

(71) Applicant: KIDS II, INC., Atlanta, GA (US)

(72) Inventors: Daniel Corso, Atlanta, GA (US); Eric A. Lange, Alpharetta, GA (US)

(73) Assignee: KIDS II, INC., Atlanta, GA (US)

( * ) Notice: Subject to any disclaimer, the term of this patent is extended or adjusted under 35 U.S.C. 154(b) by 45 days.

(21) Appl. No.: 14/722,338

(22) Filed: May 27, 2015

(65) Prior Publication Data

US 2015/0342368 A1 Dec. 3, 2015

Related U.S. Application Data

(60) Provisional application No. 62/047,694, filed on Sep. 9, 2014, provisional application No. 62/004,266, filed on May 29, 2014.

(51) Int. Cl.

| | |
|---|---|
| ***A47D 1/00*** | (2006.01) |
| ***A47D 13/10*** | (2006.01) |
| ***A47D 9/02*** | (2006.01) |

(52) U.S. Cl.

CPC ..... *A47D 13/102* (2013.01); *A47D 9/02* (2013.01)

(58) Field of Classification Search

CPC ..... A47D 1/08; A47D 1/105; A47D 1/004; A47D 1/006; B60N 2/2848; B60N 2/2842

USPC ..... 297/259.1, 259.2, 271.5, 271.6

See application file for complete search history.

(56) References Cited

U.S. PATENT DOCUMENTS

| | | | | |
|---|---|---|---|---|
| 341,238 | A | 5/1886 | Heinss | |
| 3,119,124 | A | 1/1964 | Krauss | |
| 3,206,772 | A | 9/1965 | Sarasin | |
| 3,309,718 | A | 3/1967 | Sarasin | |
| 4,258,446 | A | 3/1981 | McAllister et al. | |
| 4,371,206 | A | 2/1983 | Johnson, Jr. | |
| 4,573,224 | A | 3/1986 | Saint | |
| 4,635,305 | A | 1/1987 | Wyss | |
| 4,688,850 | A | 8/1987 | Brownlie et al. | |
| 4,697,845 | A * | 10/1987 | Kamman | A63G 9/16 297/118 |
| 4,911,499 | A | 3/1990 | Meeker | |
| 4,982,997 | A | 1/1991 | Knoedler et al. | |
| 4,986,599 | A | 1/1991 | Wise | |

(Continued)

FOREIGN PATENT DOCUMENTS

| | | |
|---|---|---|
| WO | 2008115986 A1 | 9/2008 |
| WO | 2014153490 A1 | 9/2014 |

*Primary Examiner* — Timothy J Brindley

(74) *Attorney, Agent, or Firm* — Gardner Groff Greenwald & Villanueva, PC

(57) ABSTRACT

A child-supporting device including a child-seat assembly mounted to and supported by a rocker frame assembly. The seat assembly includes a backrest, a footrest, or both, pivotably adjustable between reclined and inclined positions. A recline adjustment mechanism is operable to selectively lock the seat in the reclined or inclined position for use, then release the seat for pivotal adjustment to the other position. In some embodiments, a linkage interconnects the backrest and the footrest so that pivoting one of them synchronously pivots the other one. And in some embodiments, the footrest is detachable and a quick connect/disconnect mechanism is provided that permits operation of the recline adjustment mechanism when the footrest is attached.

19 Claims, 14 Drawing Sheets

(56) References Cited

U.S. PATENT DOCUMENTS 5,011,221 A 4/1991 Wise
5,178,438 A 1/1993 Beger
5,265,932 A 11/1993 Leonard
5,308,143 A 5/1994 Cheng et al.
5,407,246 A 4/1995 Meeker et al.
5,499,949 A 3/1996 Heubl
5,547,256 A * 8/1996 D'Antuono ..... A47D 13/105 280/642
5,575,530 A 11/1996 Harper et al.
5,863,097 A 1/1999 Harper et al.
5,868,459 A 2/1999 Welsh, Jr.
5,887,945 A 3/1999 Sedlack
5,961,180 A 10/1999 Greger et al.
6,027,409 A 2/2000 Favorito et al.
6,139,101 A 10/2000 Berringer et al.
6,174,028 B1 * 1/2001 Yang ..... A47D 13/102 280/642
6,341,816 B1 1/2002 Chen et al.
6,361,106 B1 3/2002 Huang
6,378,940 B1 4/2002 Longoria et al.
6,431,646 B1 8/2002 Longoria
6,540,292 B2 4/2003 Darling et al.
6,594,840 B2 7/2003 Tomas et al.
6,679,779 B2 1/2004 Tai et al.
6,682,137 B2 1/2004 Hsia
6,687,928 B1 2/2004 Wilson
6,739,649 B2 5/2004 Kelly et al.
6,811,217 B2 11/2004 Kane et al.
6,869,368 B1 3/2005 Clarke et al.
6,877,802 B2 4/2005 Christensen et al.
6,877,805 B1 4/2005 Steadman
7,445,559 B2 11/2008 Kakuda
7,455,353 B2 11/2008 Favorito (nee Wilkins) et al.
7,506,922 B2 3/2009 Schulte et al.
7,862,118 B2 1/2011 Sims, Jr.
7,905,791 B2 3/2011 Guang et al.
8,038,207 B2 10/2011 Flannery
8,205,943 B2 6/2012 Zhong
8,322,789 B2 12/2012 Mendes et al.
8,491,401 B2 7/2013 Szymanski
8,746,794 B2 6/2014 Oren et al.
8,844,072 B2 9/2014 Bellows et al.
D717,577 S 11/2014 Pacella et al.
2005/0054486 A1 3/2005 Turner et al.
2006/0103178 A1 5/2006 Wun
2006/0181123 A1 8/2006 Gibree
2007/0007804 A1 1/2007 Pemberton et al.
2007/0096460 A1 5/2007 Lan
2008/0290699 A1 * 11/2008 Golias ..... A47D 1/002 297/16.1
2010/0060059 A1 * 3/2010 Chen ..... A47D 1/002 297/328
2010/0230933 A1 * 9/2010 Dean ..... B60N 2/2821 280/647
2011/0148155 A1 6/2011 Chapman et al.
2011/0260507 A1 10/2011 Parness et al.
2012/0046117 A1 * 2/2012 Zhang ..... A47D 13/105 472/119
2012/0169097 A1 7/2012 Mendes
2013/0214567 A1 * 8/2013 Miller ..... A47D 1/002 297/183.6
2015/0082539 A1 * 3/2015 Lin ..... A47D 1/002 5/105

* cited by examiner

CHILD SLEEPING AND ROCKING APPARATUSES

CROSS-REFERENCE TO RELATED APPLICATIONS

This application claims the priority benefit of U.S. Provisional Patent Application Ser. No. 62/047,694 filed Sep. 9, 2014, and U.S. Provisional Patent Application Ser. No. 62/004,266 filed May 29, 2014, the entireties of which are hereby incorporated herein by reference for all purposes.

TECHNICAL FIELD

The present invention relates generally to the field of support devices for children, and more particularly to sleeping and rocking support devices for children.

BACKGROUND

Conventional child-supporting apparatuses have not proven entirely satisfactory. Accordingly, needs exist for improvements in child-sleeping apparatuses. It is to the provision of solutions meeting these and other needs that the present invention is primarily directed.

SUMMARY

The present invention relates to a child-supporting device including a child-seat assembly mounted to and supported by a rocker frame assembly. The seat assembly includes a backrest, a footrest, or both, pivotably adjustable between reclined and inclined positions. A recline adjustment mechanism is operable to selectively lock the seat in the reclined or inclined position for use, then release the seat for pivotal adjustment to the other position. In some embodiments, a linkage interconnects the backrest and the footrest so that pivoting one of them synchronously pivots the other one. And in some embodiments, the footrest is detachable and a quick connect/disconnect mechanism is provided that permits operation of the recline adjustment mechanism when the footrest is attached.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of example embodiments of the invention, and are not restrictive of the invention, as claimed.

DETAILED DESCRIPTION OF EXAMPLE EMBODIMENTS

Figure 1:
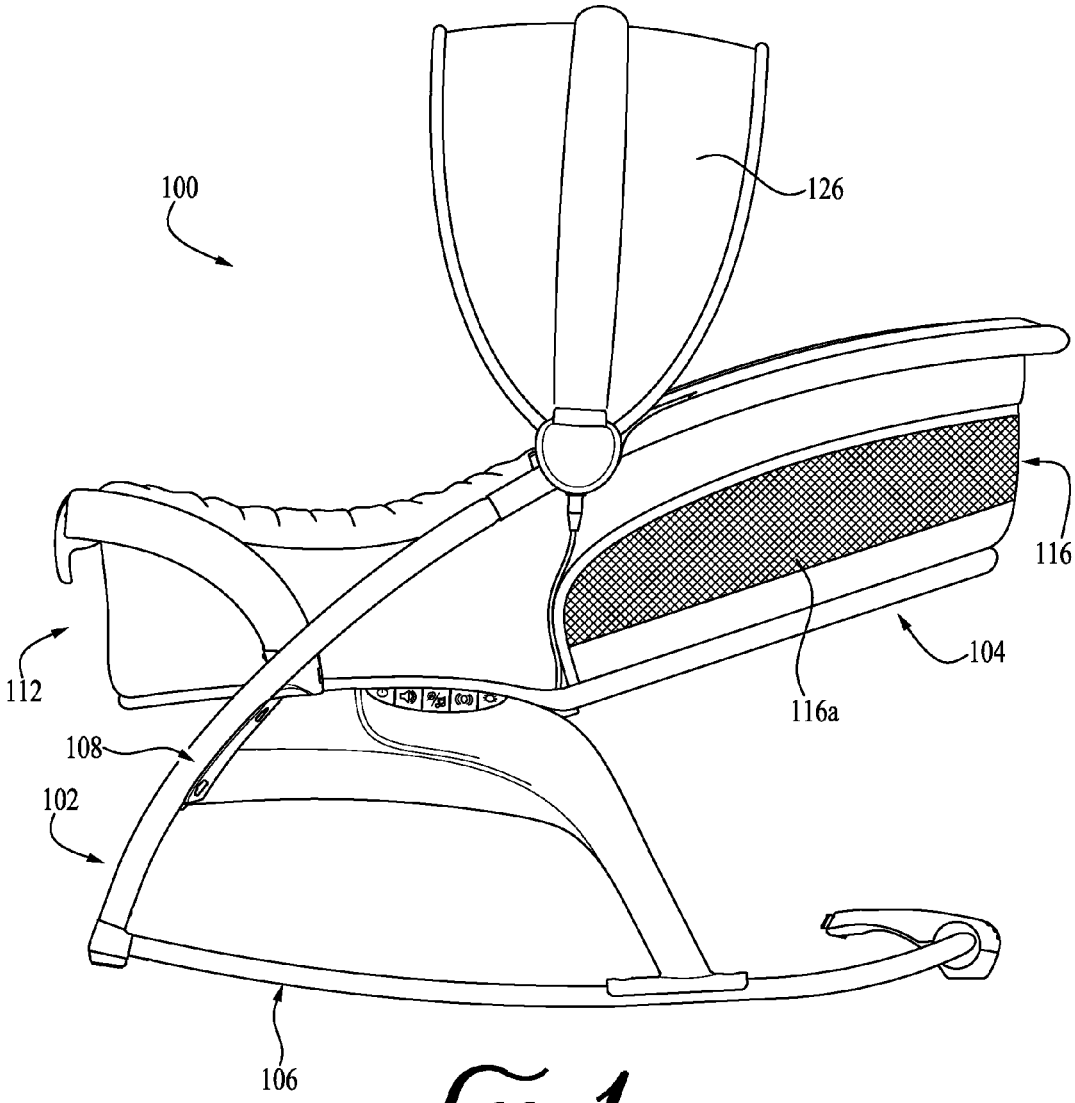
FIG. 1 is a side view of a child-sleeping apparatus according to a first example embodiment of the present invention, showing a child-seat assembly mounted to and supported by a support-frame assembly.
Figure 2:
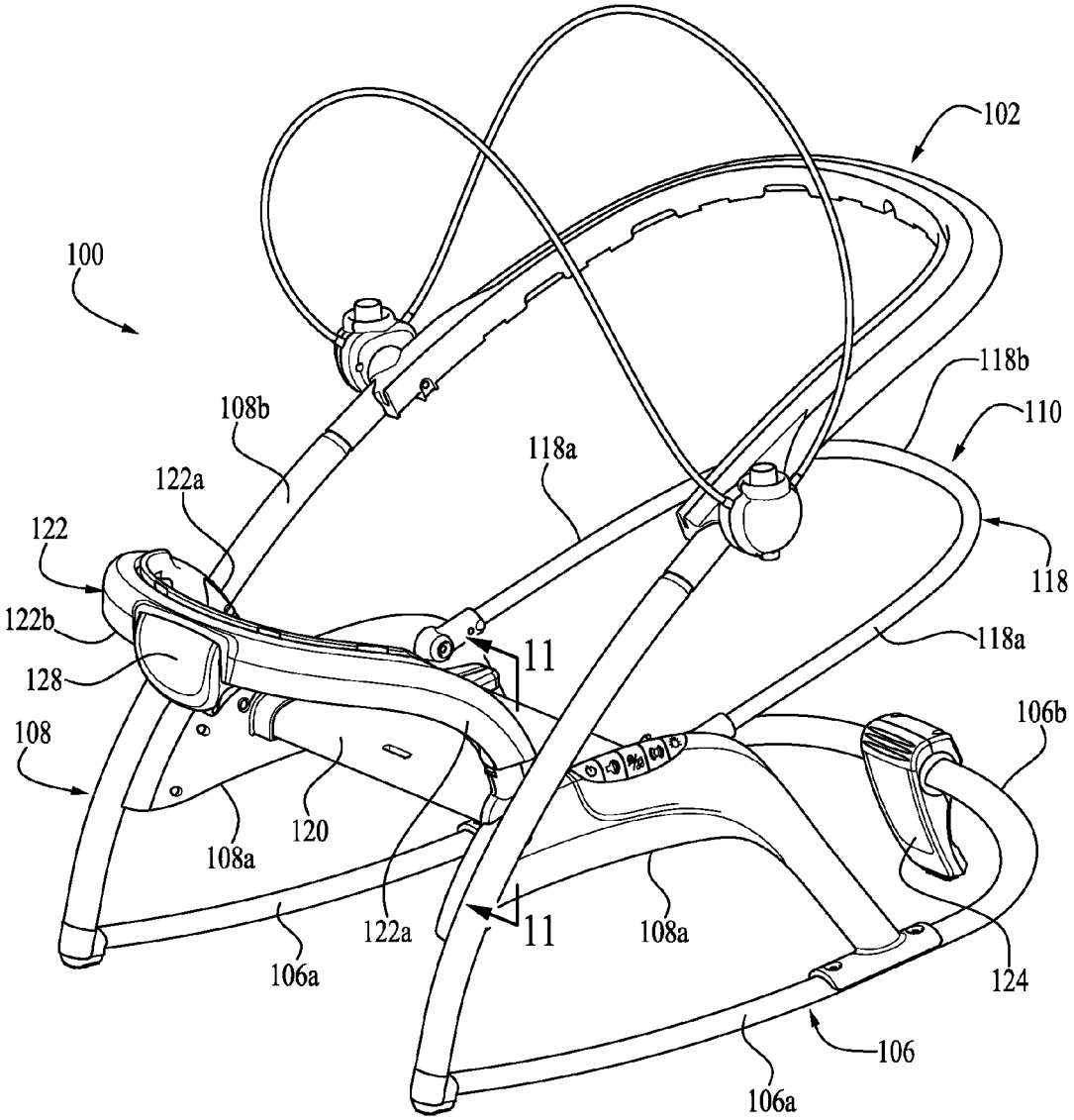
FIG. 2 is a front perspective view of the child-sleeping apparatus of FIG. 1 with the soft goods of the child-seat assembly removed to better show the structural frame members of the apparatus.
Figure 3:
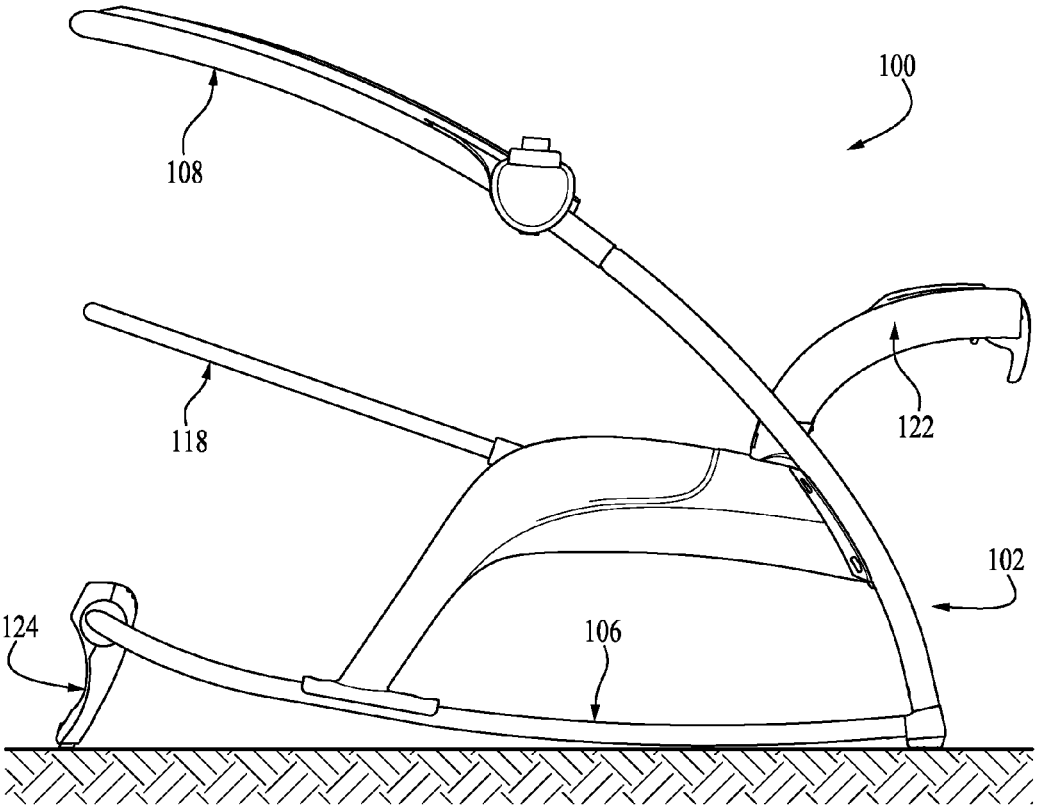
FIG. 3 is a side view of the child-sleeping apparatus of FIG. 2.
Figure 4:
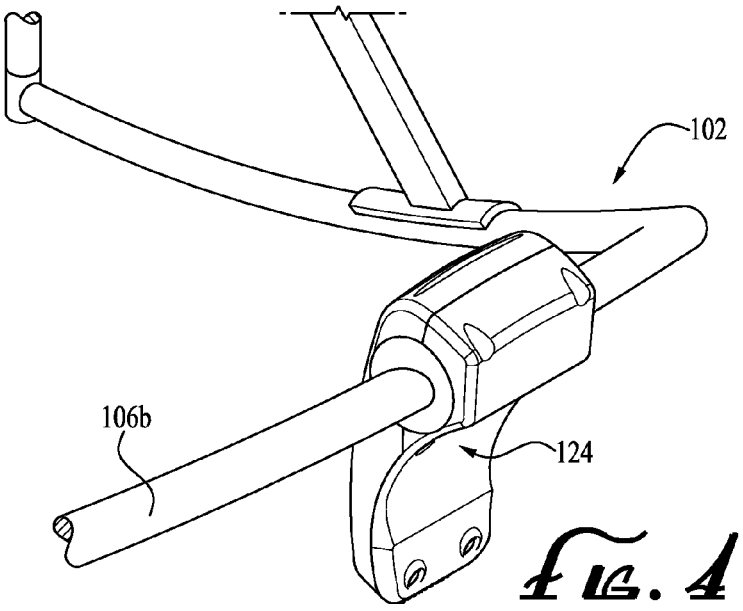
FIG. 4 is a rear perspective view of a portion of the support-frame assembly of the child-sleeping apparatus of FIG. 1.
Figure 5:
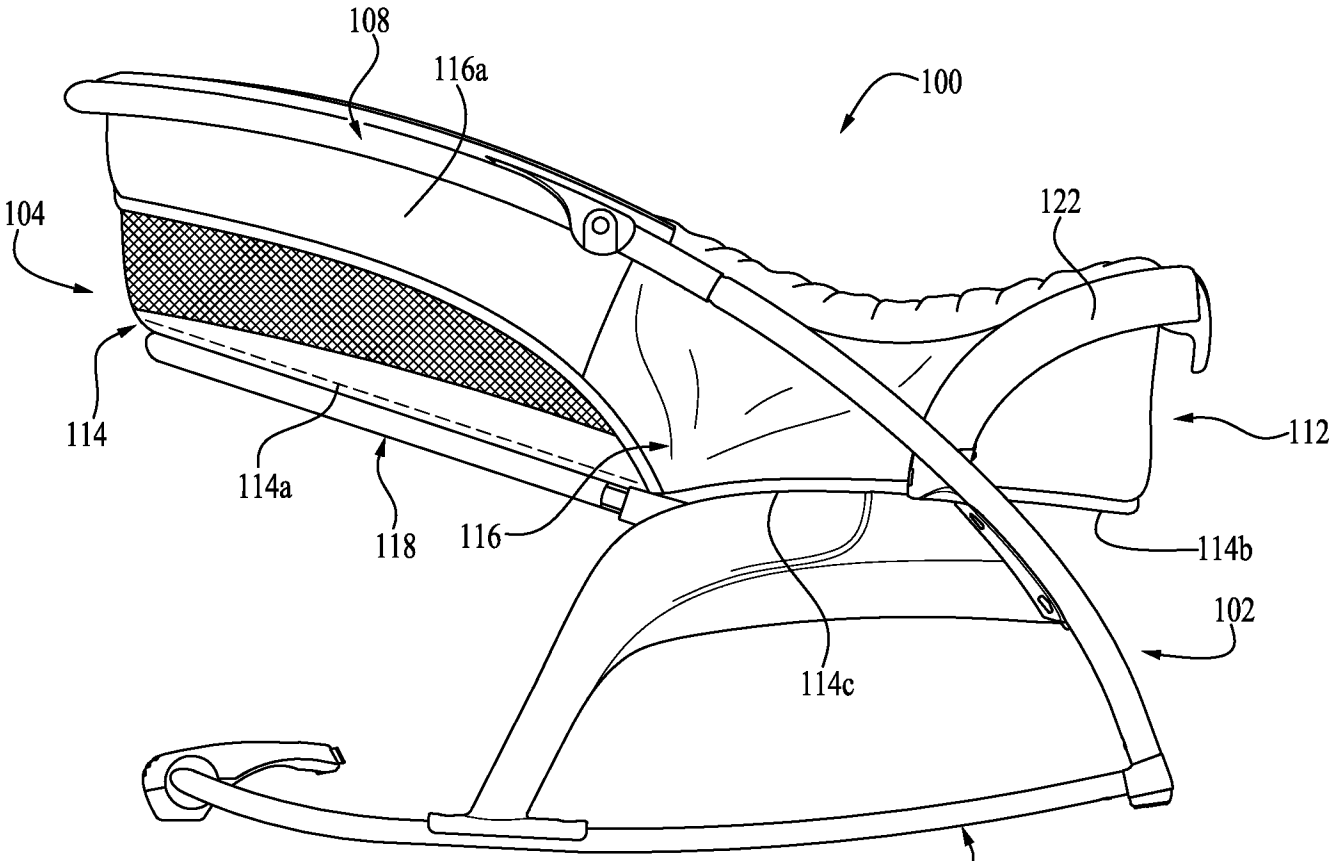
FIG. 5 is an opposite side view of the child-sleeping apparatus of FIG. 1 with the canopy removed and with the backrest and footrest in a reclined position.

The present invention may be understood more readily by reference to the following detailed description taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" one particular value and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

With reference now to the drawing figures, wherein like reference numbers represent corresponding parts throughout the several views, FIGS. 1-17 illustrate a rocker/sleeper child-support device 100 according to a first example embodiment of the invention. The child-support device 100 includes a rocker support-frame assembly 102 configured to rest on a support surface (e.g., a floor) and a child-seat assembly 104 mounted to the frame assembly, supported a height above the support surface, and adapted to hold a child. The rocker frame assembly 102 is adjustable between a rocking configuration permitting the child-support device 100 to rock back-and-forth on the support surface and a fixed configuration in which such rocking is prevented. And the seat assembly 104 is adjustable between a reclined configuration for sleeping and an inclined configuration in which the child can see out of the child-support device 100.

The rocker frame assembly 102 includes an arcuate base frame 106 that is configured to rock on the support surface, and a pedestal support frame 108 that is coupled to and extends generally upwardly from the base frame and that supports the seat assembly 104 above the support surface. In the depicted embodiment, the arcuate base frame 106 includes a generally U-shaped member formed by two spaced-apart arcuate rocker members 106*a* and a cross-member 106*b* extending between them. In other embodiments, the arcuate base frame includes one or more other-type arcuate frame elements such as a generally rectangular member, a generally H-shaped member, a lattice frame, or a panel. In the depicted embodiment, the pedestal support frame 108 includes two spaced-apart pedestal frame members 108*a* extending upward from the rocker members 106*a* and a generally U-shaped extension frame member 108*b* extending between the pedestal frame members 108*a* and upward above them (alternatively, the extension member 108*b* can be made and/or defined to be a part of the seat frame described below). In other embodiments, the support frame includes one or more other-type frame elements such as an X-shaped members or a lattice frame.

The seat assembly 104 includes a seat frame 110 mounted to the frame assembly 102 and a seat enclosure 112 supported by the seat frame. The seat frame 110 includes at least an upper support frame portion and a lower support frame portion. Typically, the seat frame 110 includes a head-support frame portion 118, a buttocks-support frame portion 120, and a foot-support frame portion 122. In the depicted embodiment, the head-support portion 118 is provided by a U-shaped member with two side members 118*a* extending rearward from the frame assembly 102 (and having two free ends mounted to the frame assembly) and a cross-member 118*b* extending therebetween to form its closed end. Similarly, the depicted foot-support portion 122 is provided by a U-shaped member with two side members 122*a* extending forward from the frame assembly 102 (and having two free ends mounted to the frame assembly) and a cross-member 122*b* extending therebetween to form its closed end. And the depicted buttocks-support portion 120 is provided by a panel extending laterally across the child-support device 100 between the pedestal frame members 108*a*. As such, the closed ends of the head-support portion 118 and the foot-support portion 122 are outwardly positioned at the rear and front of the child-support device 100 and their open ends are inwardly positioned to cooperate in forming a peripheral framework for the seat enclosure 112. In other embodiments, the components of the seat frame are provided in other configurations known to those skilled in the art, such as by panels or lattices for the head-support portion and/or the foot-support portion, and/or by two or another number of spaced-apart cross-members for the buttocks-support portion.

The seat enclosure 112 includes a floor 114 and a peripheral sidewall 116 surrounding the floor. In the depicted embodiment, the floor 114 and the peripheral sidewall 116 are made of a flexible material (e.g., a fabric), and as such these components are referred to as "soft goods." Typically, at least a portion of the floor 114 includes a reinforcement layer (e.g., of cardboard, foam, or another material) to increase the rigidity of the floor, and at least a portion of the floor is lined with a layer of cushioning material (e.g., polyester batting) to provide a comfortable surface on which the child is supported. In other embodiments, the seat enclosure components are made of other flexible materials (e.g., plastic, rubber, or composites), or some of all of them are made of rigid and/or semi-rigid materials and the design of the child-support device is adapted accordingly as would be known by persons of ordinary skill in the art.

The floor 114 of the seat enclosure 112 includes at least an upper support seat portion supported by the upper support frame portion and a lower support seat portion supported by the lower support frame portion. In the depicted embodiment, for example, the seat enclosure floor 114 includes a backrest seat-floor portion 114*a* supported by the head-support frame portion 118 of the seat frame 110, a footrest seat-floor portion 114*b* supported by the foot-support frame portion 122, and a seat-pan seat-floor portion 114*c* (from which the head-support and footrest seat portions extend on opposite sides) supported by the buttocks-support frame portion 120. Thus, as sometimes used herein, reference to the "backrest" is intended to mean the head-support portion 118 of the seat frame 110, the backrest seat portion 114*a* of the seat enclosure floor 114, or both. And similarly, reference herein to the "footrest" is intended to mean the foot-support portion 122 of the seat frame 110, the footrest seat portion 114*b* of the seat enclosure floor 114, or both.

The arcuate base frame 106 of the rocker frame assembly 102 includes a rock-stopping mechanism to selectively prohibit the base frame from rocking on the support surface. In the depicted embodiment, the rock-stopping mechanism is provided by a kickstand 124 that is pivotably coupled to the cross-member 106*b* of the base frame 106 and can be positioned in a pivoted-down blocking/interference position (FIGS. 2-4) in which the support device 100 is prohibited from rocking and a pivoted-up clear position (FIG. 1) in which the support device can rock. The kickstand 124 can include a pivot mount and a blocking arm extending therefrom, with the pivot mount including inter-engaging mechanical stop and/or lock features for defining the pivoted-down blocking position and the pivoted-up clear position. Such kickstands are known in the art, so further specifics are not detailed herein. In other embodiments, the rock-stopping mechanism is provided by a sliding block stopper located on the base frame, by a detachable interference member, or by another selectively deployable element known in the art for use to permit and prevent rocking. And in yet other embodiments, the support device is provided without a rock-stopping mechanism (for rocking use only) or with a non-rocking (e.g., non-arcuate) base frame (for fixed/non-rocking use only).

Figure 7:
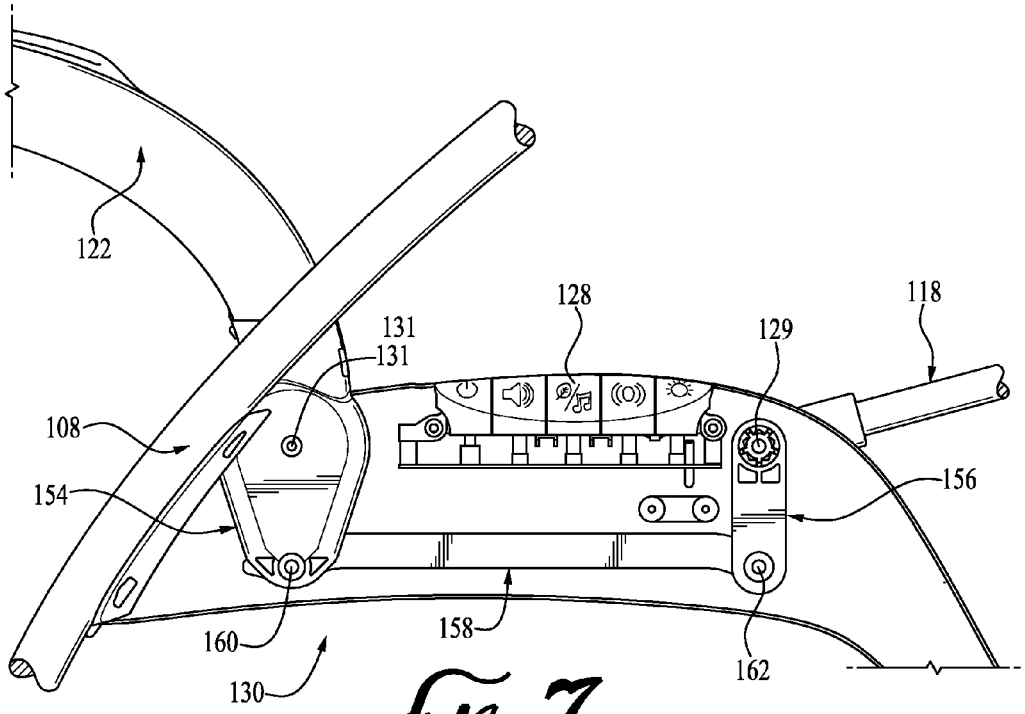
FIG. 7 is a side view of a portion of the child-sleeping apparatus of FIG. 3 with the backrest and footrest frame members in the reclined position and with the outer cover removed to reveal the internal synchronous linkage between the footrest and the backrest.

Various example embodiments of the support device 100 can include additional features for soothing, entertaining, and/or stimulating a child occupant. For example, as shown in FIG. 1, the support device 100 can include a canopy or toybar 126 positioned over the seat assembly 104. The canopy 126 depicted includes a plurality of LED lights configured to light up in a pattern that is soothing to a child. The support device 100 can also include an audio unit (not shown) configured to play music and sounds, and a vibration unit (not shown) configured to impart a soothing vibratory motion to a child occupant. As shown in FIG. 7, the support device 100 can further include a user interface 128 located on the support frame 108 that allows a caregiver to control volume, vibration speed, and other variables.

Figure 6:
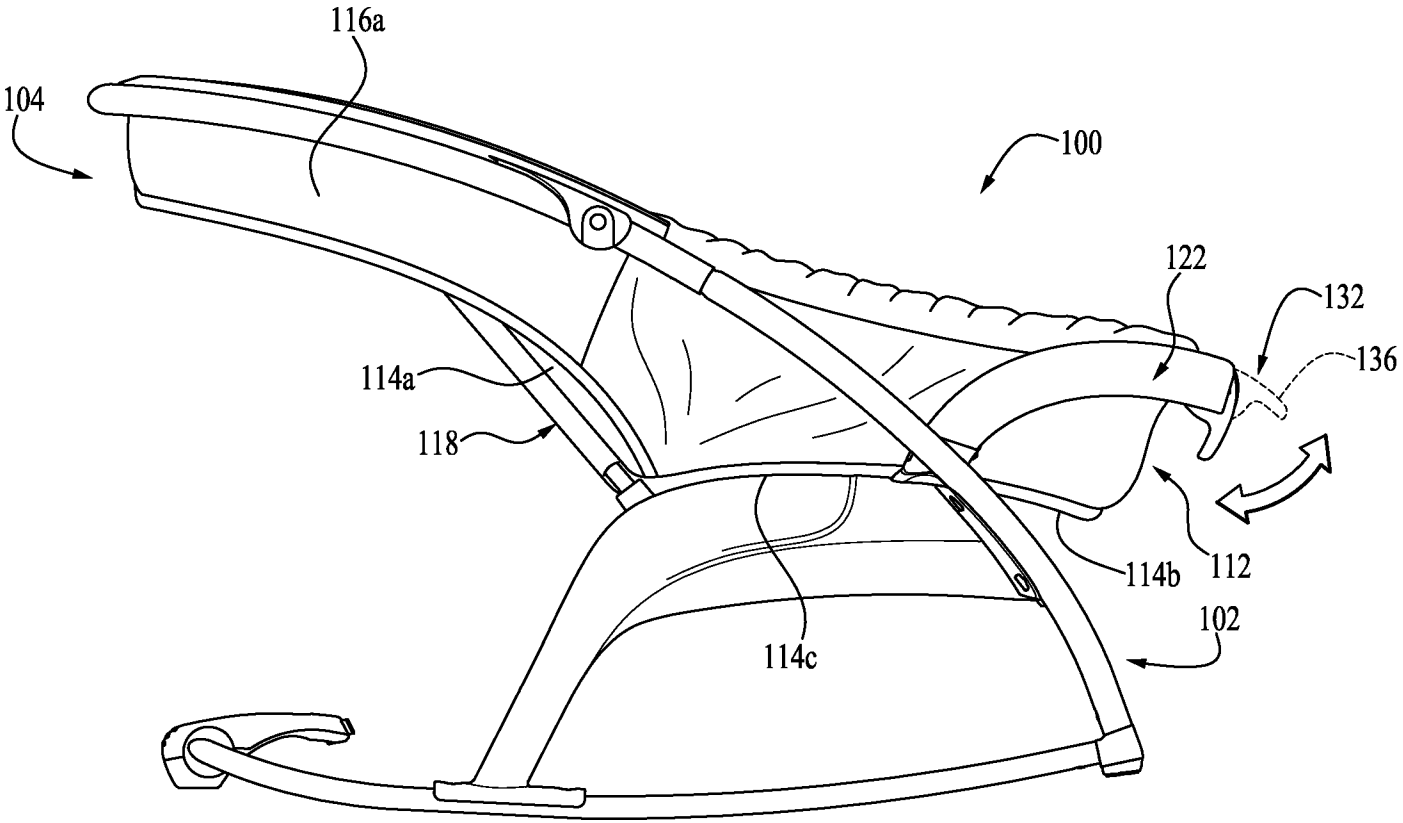
FIG. 6 shows the child-sleeping apparatus of FIG. 5 with the backrest and footrest in an inclined position.
Figure 8:
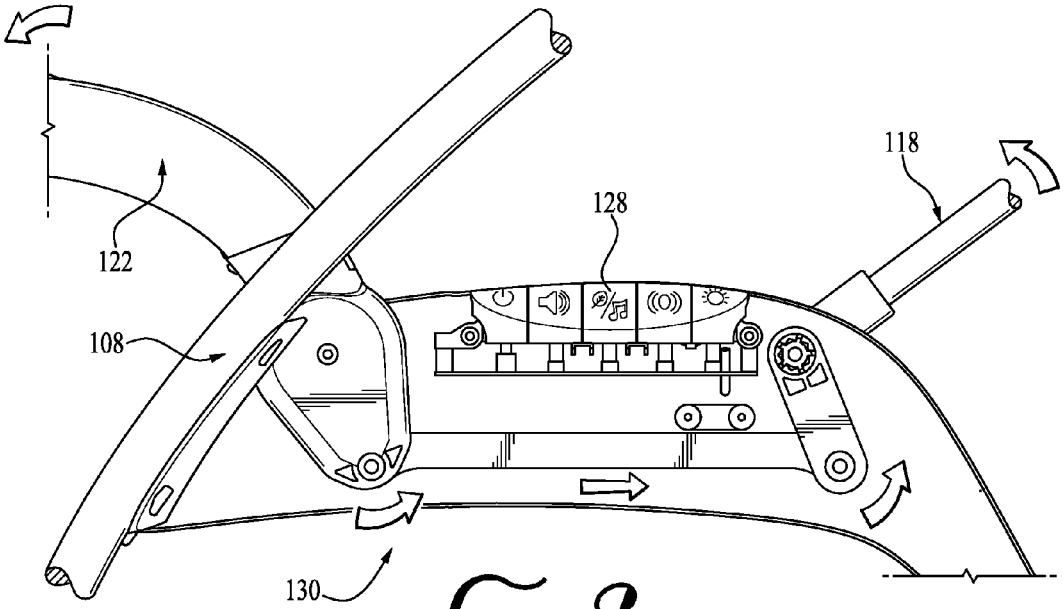
FIG. 8 shows the child-sleeping apparatus of FIG. 7 with the backrest and footrest frame members in the inclined position.
Figure 9:
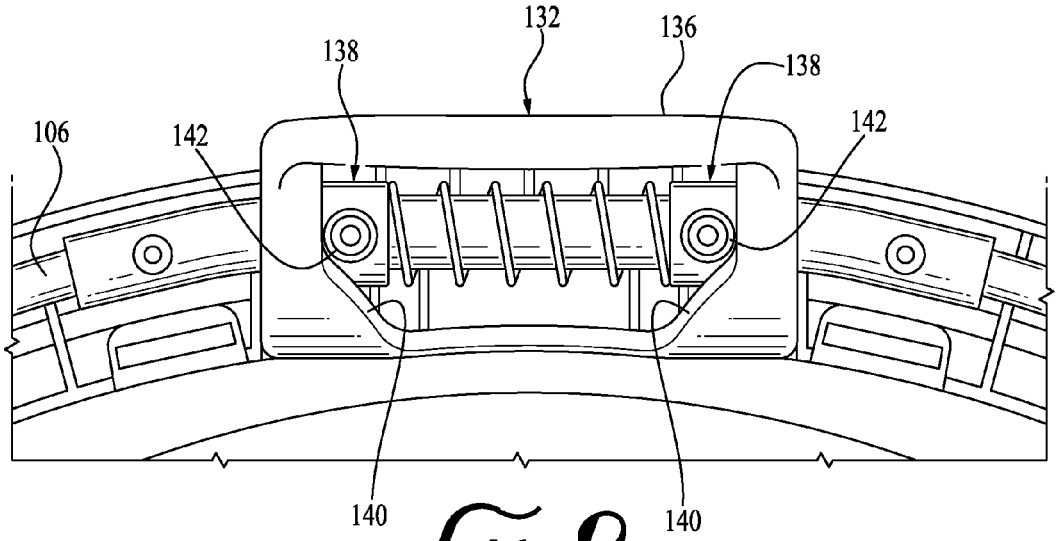
FIG. 9 is a front view of a portion of the child-sleeping apparatus of FIG. 1 showing an actuator of a recline adjustment mechanism in a lock position.
Figure 10:
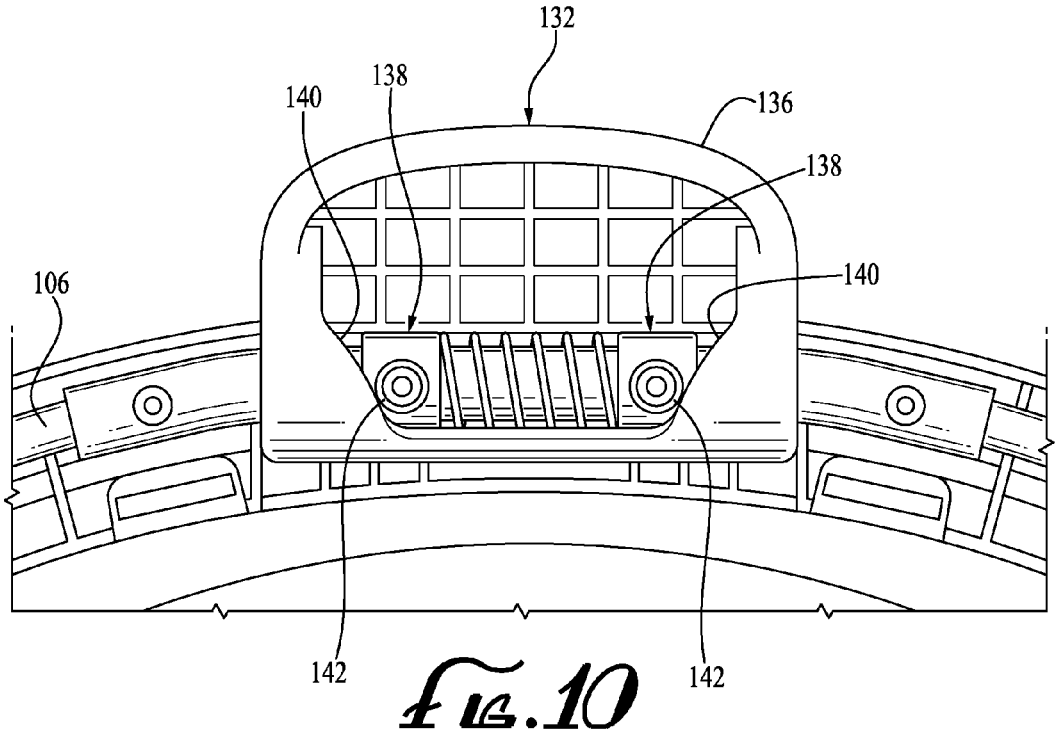
FIG. 10 shows the actuator of the child-sleeping apparatus portion of FIG. 9 in a release position.

In addition, the child-support device 100 includes a recline adjustment mechanism 130 that is operable to allow the seat assembly 104 to be selectively positioned in either a reclined position (see FIGS. 5 and 7) or an inclined position (see FIGS. 6 and 8). In the reclined position at least the backrest is laid back at a relatively small/low angle (from horizontal, when the support device 110 is in a neutral/non-rocking position) for sleeping, and in the inclined position it's raised up at a larger angle for the child's visibility. In the depicted embodiment, for example, in the reclined position the backrest seat-floor portion 114*a* is at a small/low angle (e.g., about 10 degrees to about 17 degrees above horizontal) and the footrest seat-floor portion 114*b* is at a small/low angle (e.g., substantially horizontal). And for example in the inclined position the backrest seat-floor portion 114*a* is pivoted up to a larger angle (e.g., about 40 degrees to about 70 degrees above horizontal) and the footrest seat-floor portion 114*b* is pivoted down to a larger angle (e.g., about 10 degrees to about 20 degrees below horizontal).

The seat assembly 104 is repositioned between the reclined and inclined positions by pivotal motion, with the footrest and/or the backrest being pivotally mounted to enable such pivotal motion. For example, the head-support frame portion 118 of the seat frame 110 can be pivotally mounted to the pedestal support frame 108 of the rocker frame assembly 102 (and/or to the seat-pan floor 114*c*) at a pivot axis 129 and the foot-support frame portion 122 can be pivotally mounted to the pedestal support frame (and/or to the seat-pan floor) at a pivot axis 131, as depicted (see FIGS. 7-8). In addition, the peripheral sidewall 116 being formed of a flexible material permits its backrest portion 116*a* to collapse into a compact folded arrangement against the fixed frame extension member 108*b* as the seat assembly 104 is pivoted from the reclined position to the inclined position (see FIGS. 5-6).

The recline mechanism 130 can be locked in either the reclined or the inclined position for use and unlocked/released to allow for repositioning movement to the other position. In some embodiments, the recline mechanism is adapted to provide for locking and release of the support device in one or more intermediate positions between the inclined and reclined positions.

In particular, the recline mechanism 130 includes at least one actuator that is operable to selectively lock and release at least one latch mechanism, with the support device being locked in the inclined or reclined position when the actuator is in the locked position and with the support device being unlocked and free to be repositioned between the inclined and reclined positions when the actuator is in the release position. To adjust the seat assembly 104 from the reclined position to the inclined position (or vice versa), a user operates the actuator to unlock the recline mechanism 130 and then repositions the seat assembly (footrest and/or backrest) as desired.

In typical embodiments, the recline adjustment mechanism 130 includes one actuator mechanism 132 that is operable to selectively lock and release two latch mechanisms 134. For example, the actuator mechanism 132 can include a pivotal lever 136 and two sliding shuttles 138 mounted to the seat frame 110. The pivotal lever 136 is pivotally mounted so that it can be pivoted (as indicated by the motion-indicating arrow in FIG. 6) between the locked position (see FIG. 9 and solid lines in FIG. 6) and the release position (see FIG. 10 and phantom lines in FIG. 6). The sliding shuttles 138 slide axially along the seat frame 110 and are spring-biased away from each other (e.g., by the depicted tension coil spring). The pivotal lever 136 includes two ramped cam surfaces 140 engaging two followers 142 of the shuttles 138 arranged so that when the lever is manually moved from the lock position to the release position, the cam surfaces drive the shuttles inward against the spring force, and when the lever is released, the spring force biases the shuttles away from each other with the followers in turn driving the lever back to the locked position. In other embodiments, the actuator mechanism 132 is of a conventional design such as a slide, rotary, push-pin, or similar mechanism.

Figure 12:
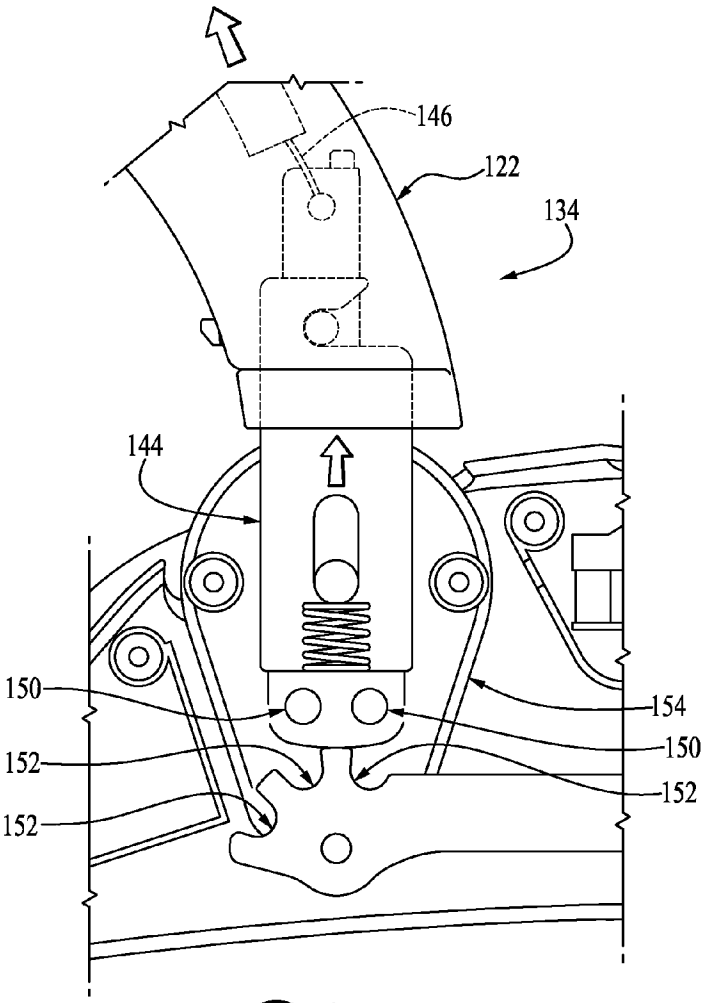
FIG. 12 shows the latch mechanism of the child-sleeping apparatus portion of FIG. 11 in a release position.
Figure 11:
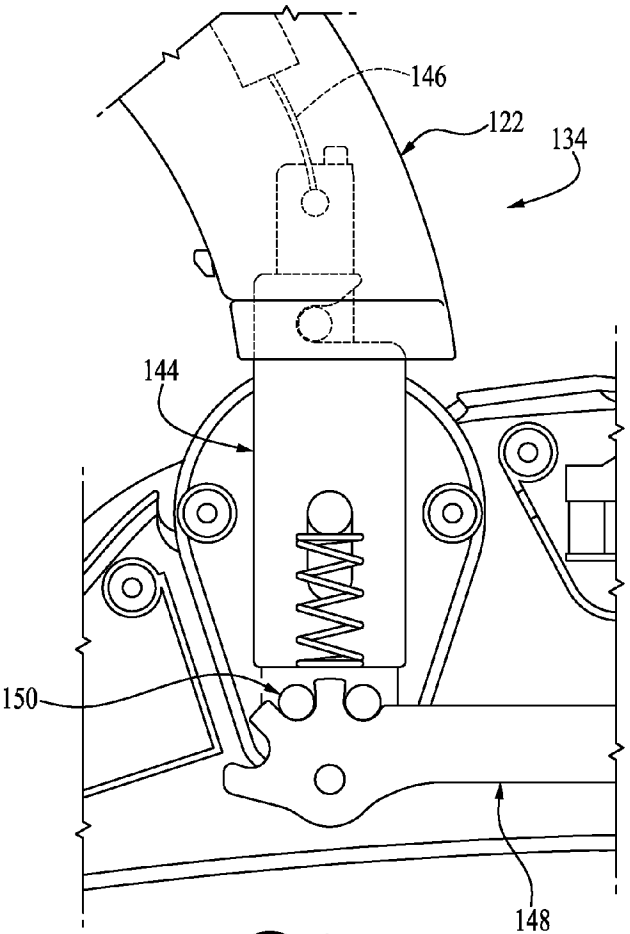
FIG. 11 is a side view of a portion of the child-sleeping apparatus of FIG. 1 with the outer cover removed to reveal internal components of a latch mechanism in a lock position and with the seat in the inclined position.
Figure 13:
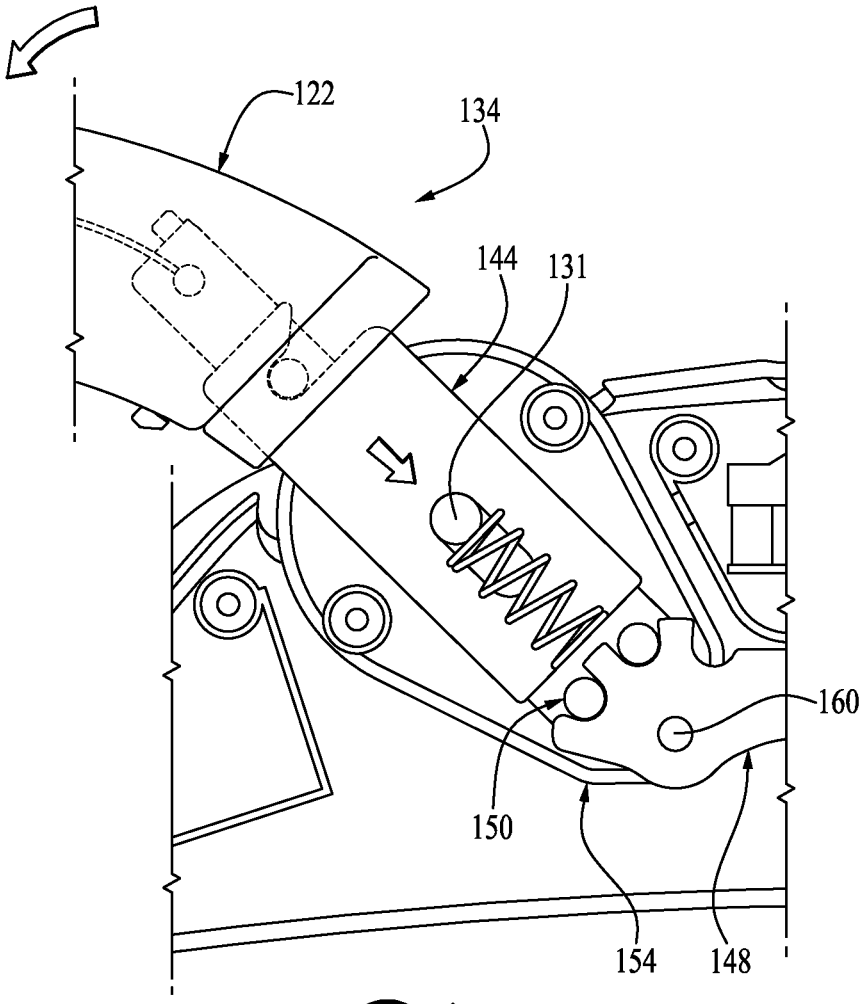
FIG. 13 shows the latch mechanism of the child-sleeping apparatus portion of FIG. 12 in the lock position with the seat now in the reclined position.
Figure 14:
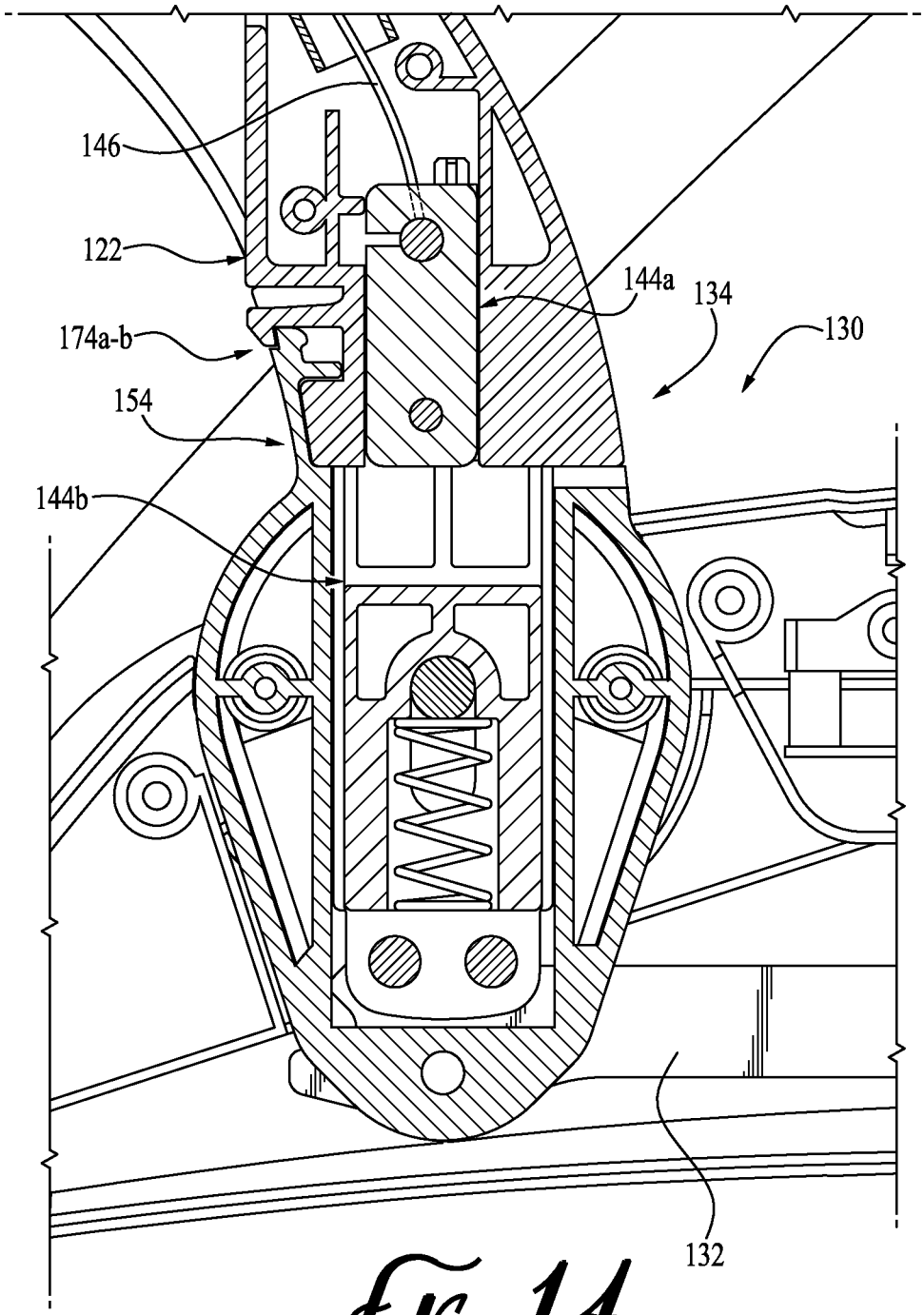
FIG. 14 is a cross-sectional view of a portion of the child-sleeping apparatus of FIG. 1 showing components of disconnect mechanism for detaching the footrest.
Figure 15:
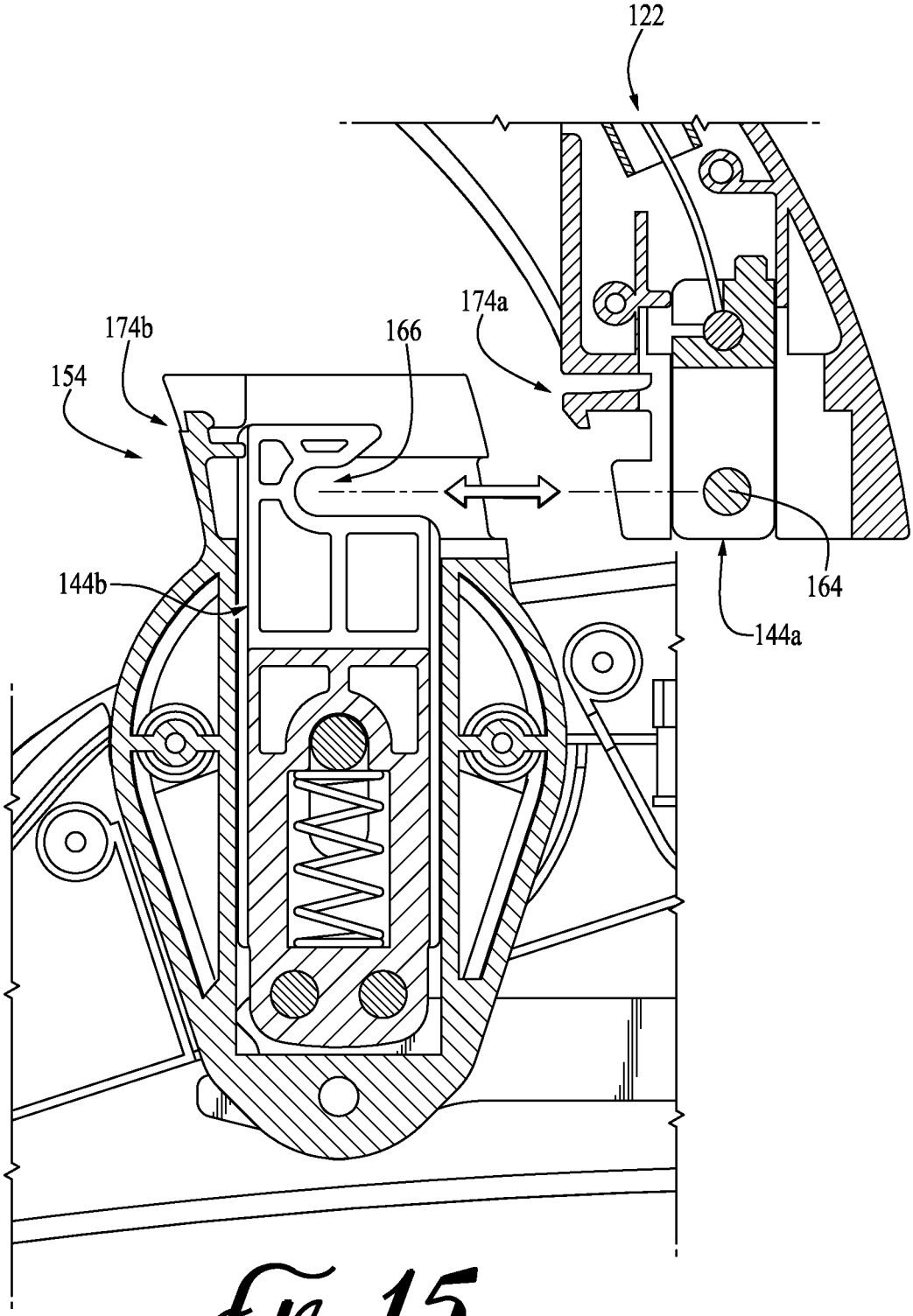
FIG. 15 shows the child-sleeping apparatus portion of FIG. 14 with the footrest detached.
Figure 16:
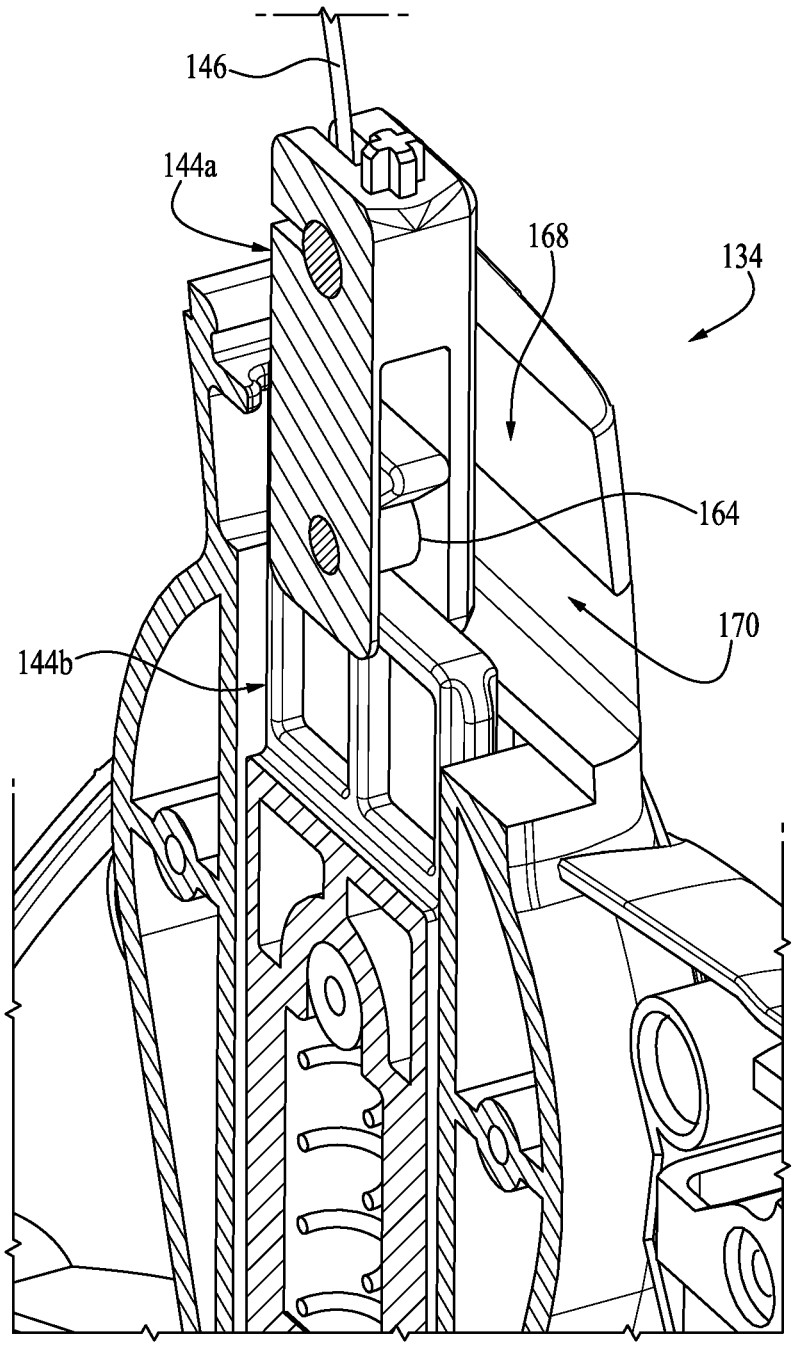
FIG. 16 is a rear perspective cross-sectional view of a portion of the child-sleeping apparatus of FIG. 1 showing components of the footrest disconnect mechanism.
Figure 17:
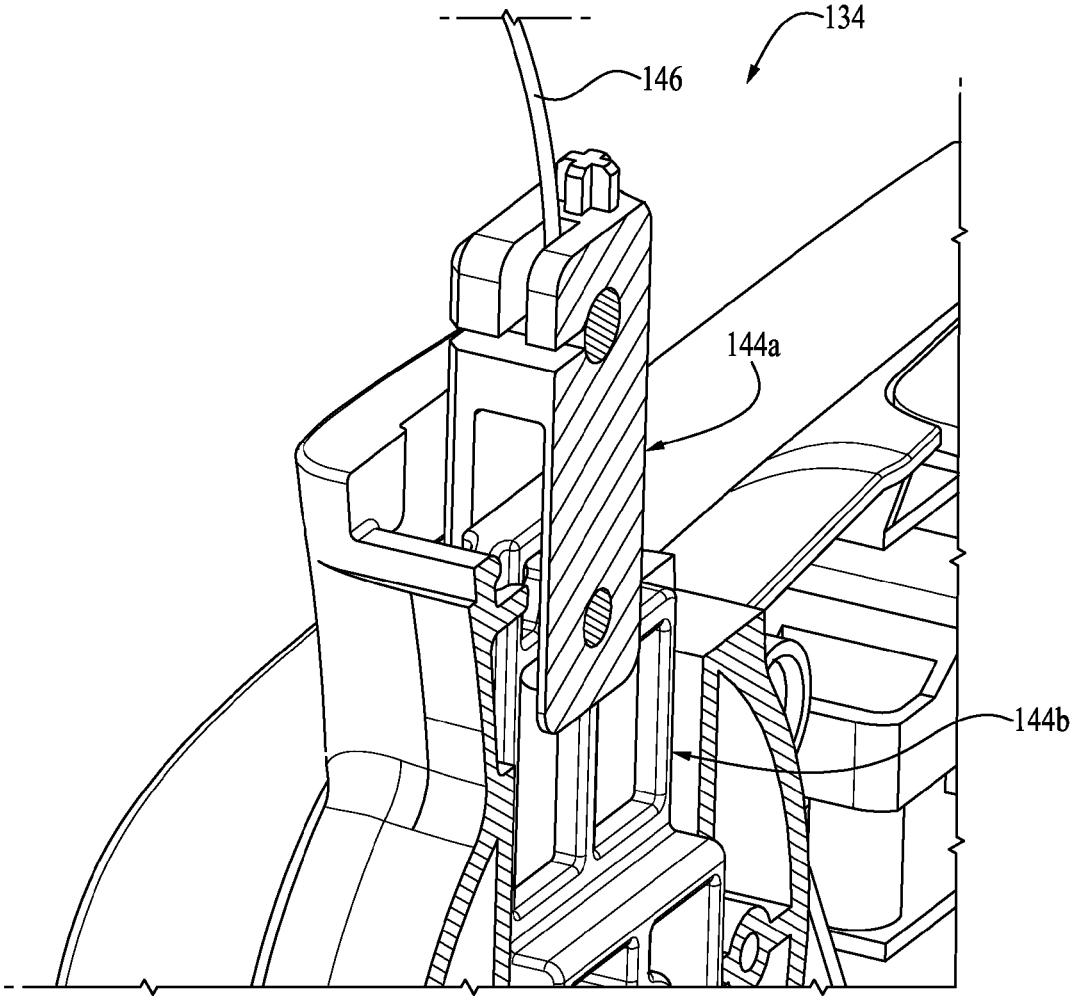
FIG. 17 is a front perspective cross-sectional view of a portion of the child-sleeping apparatus of FIG. 1 showing components of the footrest disconnect mechanism.

Referring particularly to FIGS. 11-13, the latch mechanisms 134 each include a movable lock member 144 positioned on the seat frame 110 and operably coupled to a respective one of the shuttles 142 by a force-transmitting connection element 146, and a catch member 148 positioned on the pedestal support frame 108, with the movable lock member and the catch member having mating engagement elements 150 and 152. The connection 146 can be for example a cable (as depicted), wire, cord, rod, tube, or other flexible, rigid, or semi-rigid element to transmit forces from the respective shuttle 138 to the respective lock member 144. The lock member 144 can be for example a plunger that is spring-biased (e.g., by a compression coils spring, toward the locked position) and reciprocates between the locked and release positions (as depicted), or a rotary, pivotal hook, or other lock member that moves in response to pulling or pushing force imparted via the connection 146. The lock member 144 can include for example two (or another number of) engagement elements 150 in the form of pins (as depicted), tabs, hooks, or other locking engagement elements. The catch member 148 can include for example a curved body coupled to a footrest stub 154 (e.g., one on each side) defining a series of for example three (or another number of) engagement elements 152 in the form of notches (as depicted), recesses, tabs, hooks, or other locking engagement elements.

In use, the engagement elements 150 and 152 are engaged in the lock position to retain the seat assembly 104 in the inclined position in FIG. 11. When the actuator 132 is activated, the lock member 144 is displaced to its release position, thereby disengaging the engagement elements 150 and 152, as indicated by the motion arrows of FIG. 12. The seat assembly 104 is then pivotally repositioned to the reclined position, and then the actuator 132 is released to re-engage the engagement elements 150 and 152 back to the lock position, as indicated by the motion arrows of FIG. 13.

A separate recline mechanism can be provided for each of the backrest and the footrest. Or a single recline mechanism can be provided for only the backrest, only the footrest, or both the backrest and the footrest.

In the depicted embodiment, the single recline mechanism 130 is provided for the footrest, with the actuator 132 mounted to the foot-support frame portion 122 (e.g., the cross-member 122*b*). To facilitate this, the head-support frame portion 118 and foot-support frame portion 122 are operatively connected for synchronous movement by a linkage configured such that, as the seat assembly 104 is repositioned from the reclined position to the inclined position, the head-support portion raises as the foot-support portion simultaneously lowers, and vice versa. As shown in FIGS. 7-8, for example, the linkage can include the footrest stub (e.g., crank arm) 154 which is pivotal about and extends from the footrest pivot axis 131 (e.g., extending longitudinally from the foot-support frame portion 122 on the opposite side of the pivot), a pivotal backrest stub (e.g., crank arm) 156 pivotal about and extending from the backrest pivot axis 129 (e.g., offset laterally and angled from the head-support frame portion 118 but mounted on the same pivot), a connecting member 158 extending between and pivotally coupled to the footrest and backrest stubs at respective pivot axes 160 and 162. As the foot-support frame portion 122 is lowered, the connecting member 158 pivotally connected to and extending between the foot-support portion and head-support frame portion 118 causes the head-support portion to simultaneously raise, repositioning the seat assembly 104 to the inclined position. In other embodiments, the linkage includes a gear-set or another mechanism motion-conversion mechanism. And in other embodiments, the linkage is not provided and the footrest and the backrest are independently pivotal.

Furthermore, in some embodiments such as that depicted, a quick connect/disconnect mechanism is included that permits the foot-support frame portion 122 to be packaged detached from the child-support device 100 for compactness and then attached for use (and in some embodiments such as that depicted it than later be detached for compactness during transport for example in a caretaker's vehicle). In such embodiments, the latch mechanisms 134 can each include a two-part decouplable lock member 144, with a first lock member portion 144*a* on the foot-support frame portion 122 and a second lock member portion 144*b* on the footrest stub 154, and with the two lock member portions including releasably mating connection elements 164 and 166 for recline-adjustment locking and releasing. For example, the footrest stub 154 can include a female coupling receiver 168 with a lateral opening 170, with the second lock member portion 144*b* including a connection element 166 in the form of a slot (as depicted) positioned in the receiver. And the foot-support frame portion 122 can include a male coupling insert 172 that slides into the receiver 168 laterally through the lateral opening 170 (as indicated by the directional arrow in FIG. 15), with the first lock member portion 144*a* including a connection element 164 in the form of a pin (as depicted) that slides into and out of the slot 166. Releasable retainer elements 174*a* and 174*b* such as detents selectively secure the foot-support frame portion 122 to the footrest stub 154 for structural support. In other embodiments, the disconnect mechanism includes telescoping elements, snap-fit elements, push-button elements, or other structures known in the art to permit selective detachment of two parts having two points of engagement (one for structural support and the other for recline-adjustment locking and releasing).

Figure 18:
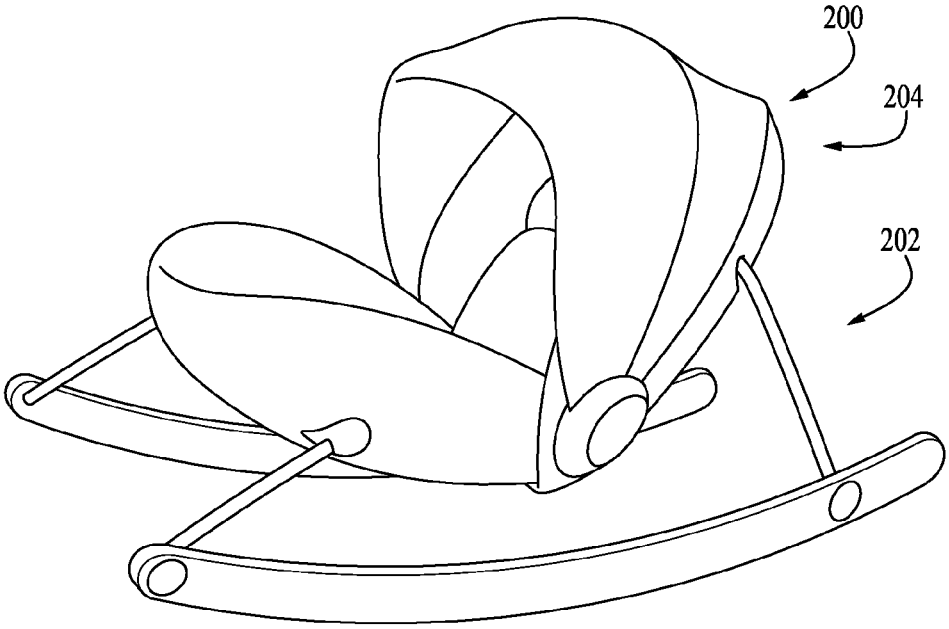
FIG. 18 is a perspective view of a child-sleeping apparatus according to a second example embodiment of the present invention, showing the backrest and footrest in the inclined position.
Figure 19:
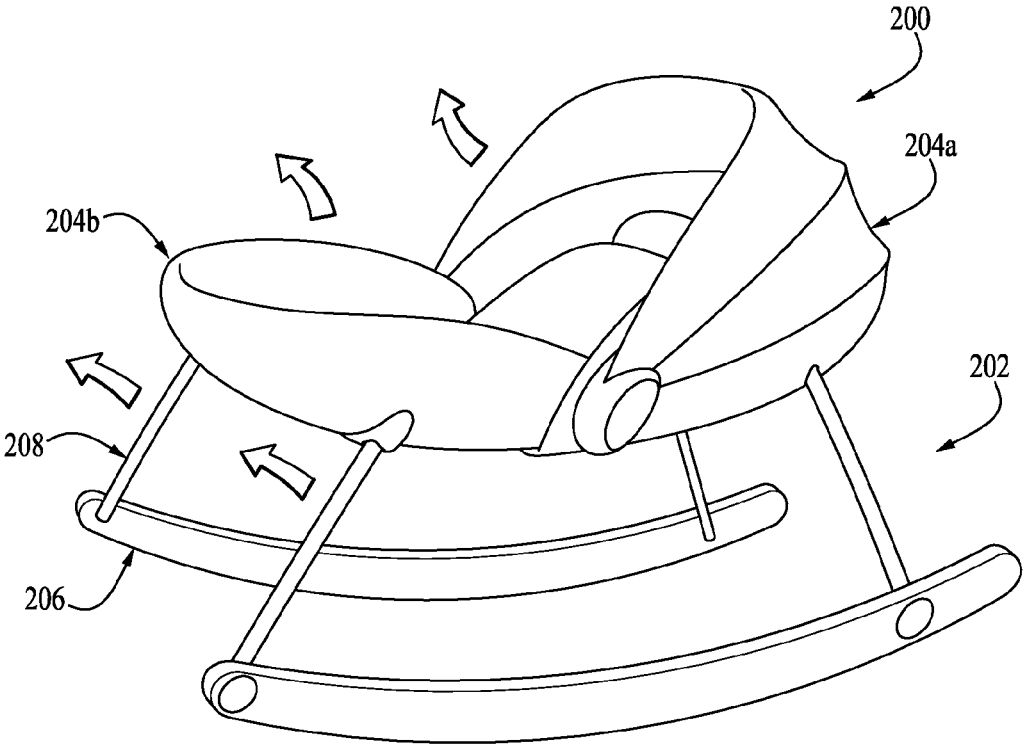
FIG. 19 shows the child-sleeping apparatus of FIG. 18 with the backrest and footrest in the reclined position.

FIGS. 18-19 show a child-support device 200 according to a second embodiment of the invention. Similarly to the first embodiment, the child-support device 200 includes a rocker support-frame assembly 202 configured to rest on a support surface (e.g., a floor) and a child-seat assembly 204 mounted to the frame assembly, supported a height above the support surface, and adapted to hold a child. The rocker frame assembly 202 includes an arcuate base frame 206 that is configured to rock on the support surface, and a pedestal support frame 208 that is coupled to and extends generally upwardly from the base frame and that supports the seat assembly 204 above the support surface. And the seat assembly 204 is adjustable between a reclined configuration for sleeping and an inclined configuration in which the child sits more upright.

In this embodiment, however, the pedestal support frame 208 includes four support legs extending upward from the two rocker members of the arcuate base frame 206, with at least two of the legs pivotally coupled to the two rocker members. And the child-seat assembly 204 includes an upper seat portion 204*a* and a lower seat portion 204*b* that pivot relative to each other. In the depicted embodiment, for example, the rear support legs 208 are pivotally coupled to the upper seat portion 204*a*, the front support legs are pivotally coupled to the lower seat portion 204*b* and the rocker members 206, and the upper and lower seat portions are pivotally coupled together at a middle hinge.

While the invention has been described with reference to preferred and example embodiments, it will be understood by those skilled in the art that a variety of modifications, additions and deletions are within the scope of the invention, as defined by the following claims.

What is claimed is:

1. An apparatus for supporting a child above a support surface, comprising:

a support-frame assembly configured to rest on the support surface;

a child-seat assembly mounted to the support-frame assembly, supported above the support surface, and adapted to hold the child, wherein the child-seat assembly includes at least one child-supporting floor portion that is pivotal between a reclined position and an inclined position, wherein the child-seat assembly includes a seat enclosure that holds the child and a seat frame that supports the seat enclosure and is mounted to and supported by the support-frame assembly, and wherein the seat frame includes a pivotal child-supporting seat-frame portion supporting the pivotal child-supporting seat-floor portion;

a connect/disconnect mechanism including releasably mating connection elements that permit the child-supporting seat-frame portion to be detached from the child-supporting apparatus; and a recline adjustment mechanism that is selectively operable to lock the child-seat assembly in the reclined position and the inclined position and to release the child-seat assembly so that it can be adjusted between the reclined position and the inclined position, the recline adjustment mechanism including at least one actuator, at least one latch mechanism having at least one lock member movable between a lock position and a release position, and a connection element extending between the actuator and the at least one lock member so that activating the actuator moves the at least one lock member between the lock and release positions.

2. The child-supporting apparatus of claim 1, wherein the at least one child-supporting floor portion comprises a footrest portion and a backrest portion of the child-seat assembly.

3. The child-supporting apparatus of claim 2, further comprising linkage connecting the footrest portion and the backrest portion of the child-seat assembly for synchronous motion so that, with the child-seat assembly in the reclined position, pivoting the footrest portion downward to the inclined position causes the backrest portion to pivot upward to the inclined position.

4. The child-supporting apparatus of claim 3, wherein the linkage includes a connecting member pivotally connected between a pivotal footrest stub or crank arm extending from and pivotal about a pivot of the footrest portion and a pivotal backrest stub or crank arm extending and pivotal about a pivot of from the backrest portion.

5. The child-supporting apparatus of claim 1, wherein the actuator includes a lever having at least one ramped cam and at least one shuttle having at least one follower that engages and rides long the ramped cam, wherein the shuttle is attached to the connection element that is in turn attached to the at least one lock member, and wherein pivoting the lever causes the ramped cam to displace the shuttle which in turn cause the at least one lock member to displace from the lock position to the release position.

6. The child-supporting apparatus of claim 1, wherein the at least one latch mechanism includes a catch member mounted to the support-frame assembly and the at least one lock member is mounted to and linearly reciprocates relative to the child-seat assembly between the lock position and the release position.

7. The child-supporting apparatus of claim 6, wherein the at least one lock member includes at least one engagement element and the catch member includes at least one engagement element that is engaged by the at least one lock member engagement element in the lock position and that is not engaged by the at least one lock member engagement element in the release position.

8. The child-supporting apparatus of claim 1, wherein the at least one lock member of the at least one latch mechanism includes two detachable lock-member portions adapted to provide for recline-adjustment locking and releasing of the child-supporting seat-frame portion, and further comprising two releasably mating retainer elements adapted to provide for structural support of the child-supporting seat-frame portion.

9. The child-supporting apparatus of claim 1, wherein the at least one lock member of the at least one latch mechanism includes a first lock member portion coupled to the child-supporting seat-frame portion and a second lock member portion coupled to another part of the child-supporting apparatus, wherein the first lock member portion defines a first one of the releasably mating connection elements and the second lock member portion defines a second one of the releasably mating connection elements.

10. The child-supporting apparatus of claim 1, wherein the support-frame assembly includes a base frame and a pedestal support frame mounted to and extending above the base frame, the base frame is configured for resting on the support surface, the seat assembly includes a seat enclosure that holds the child and a seat frame that supports the seat enclosure and is mounted to the pedestal support frame, the pedestal support frame or the seat frame includes an extension member that extends above and supports the seat enclosure in suspension, the seat enclosure includes a seat floor that supports the child and a sidewall extending between the seat floor and the extension member, and the sidewall is made of a flexible material so that when the seat floor is pivoted from the reclined position upward, closer to the extension member, into the inclined position, then the sidewall folds and collapses.

11. The child-supporting apparatus of claim 1, wherein the support-frame assembly includes an arcuate rocking base frame configured for rocking on the support surface and a rock-stopping mechanism adjustable between a blocking position preventing the rocking motion and a clear position permitting the rocking motion.

12. An apparatus for supporting a child above a support surface, comprising:

a support-frame assembly including an arcuate rocking base frame configured for rocking on the support surface, a rock-stopping mechanism adjustable between a blocking position preventing the rocking motion and a clear position permitting the rocking motion;

a child-seat assembly mounted to the support-frame assembly, supported above the support surface, and adapted to hold the child, wherein the child-seat assembly includes a seat frame supporting a seat enclosure, the seat frame includes a foot-supporting seat-frame portion and a head-supporting seat-frame portion that are each pivotal between a reclined position and an inclined position, the seat enclosure includes a floor and a peripheral sidewall extending between the floor and an extension frame member, and the seat-enclosure sidewall is made of a flexible material so that when the foot-supporting seat-frame portion is pivoted from the reclined position upward toward the extension member and into the inclined position then the sidewall folds and collapses;

a linkage connecting the foot-supporting seat-frame portion and the head-supporting seat-frame portion of the child-seat assembly for synchronous motion so that, with the child-seat assembly in the reclined position, pivoting the foot-supporting seat-frame portion downward to the inclined position causes the head-supporting seat-frame portion to pivot upward to the inclined position; and a recline adjustment mechanism that is selectively operable to lock the child-seat assembly in the reclined position and the inclined position and to release the child-seat assembly so that it can be adjusted between the reclined position and the inclined position, the recline adjustment mechanism including at least one actuator, at least one latch mechanism having at least one lock member movable between a lock position and a release position, and a connection element extending between the actuator and at least one the lock member so that activating the actuator moves the at least one lock member between the lock and release positions.

13. The child-supporting apparatus of claim 12, wherein the linkage includes a connecting member pivotally connected between a pivotal footrest stub or crank arm extending from and pivotal about a pivot of the head-supporting seat-frame portion and a pivotal backrest stub or crank arm extending from and pivotal about a pivot of the head-supporting seat-frame portion.

14. The child-supporting apparatus of claim 1, wherein the actuator includes a lever having at least one ramped cam and at least one shuttle having at least one follower that engages and rides long the ramped cam, wherein the shuttle is attached to the connection element that is in turn attached to the at least one lock member, and wherein pivoting the lever causes the ramped cam to displace the shuttle which in turn cause the at least one lock member to displace from the lock position to the release position.

15. The child-supporting apparatus of claim 1, wherein the at least one latch mechanism includes a catch member mounted to the support-frame assembly and the at least one lock member is mounted to and linearly reciprocates relative to the child-seat assembly between the lock position and the release position.

16. The child-supporting apparatus of claim 15, wherein the at least one lock member includes at least one engagement element and the catch member includes at least one engagement element that is engaged by the at least one lock member engagement element in the lock position and that is not engaged by the at least one lock member engagement element in the release position.

17. The child-supporting apparatus of claim 1, further comprising a connect/disconnect mechanism including releasably mating connection elements that permit the foot-supporting seat-frame portion to be detached from the child-supporting apparatus.

18. The child-supporting apparatus of claim 17, wherein the at least one lock member of the at least one latch mechanism includes two detachable lock-member portions adapted to provide for recline-adjustment locking and releasing of the foot-supporting seat-frame portion, and further comprising two releasably mating retainer elements adapted to provide for structural support of the foot-supporting seat-frame portion.

19. The child-supporting apparatus of claim 17, wherein the at least one lock member of the at least one latch mechanism includes a first lock member portion coupled to the foot-supporting seat-frame portion and a second lock member portion coupled to another part of the child-supporting apparatus, wherein the first lock member portion defines a first one of the releasably mating connection elements and the second lock member portion defines a second one of the releasably mating connection elements.

* * * * *